US009428995B2

(12) United States Patent
Holt

(10) Patent No.: US 9,428,995 B2
(45) Date of Patent: Aug. 30, 2016

(54) MULTI-CHANNEL CONDUIT AND METHOD FOR HEATING A FLUID

(71) Applicant: FREEDOM OILFIELD SERVICES, INC., Rock Springs, WY (US)

(72) Inventor: Arthur H. Holt, Rock Springs, WY (US)

(73) Assignee: Freedom Oilfield Services, Inc., Rock Springs, WY (US)

( * ) Notice: Subject to any disclaimer, the term of this patent is extended or adjusted under 35 U.S.C. 154(b) by 366 days.

(21) Appl. No.: 14/100,807

(22) Filed: Dec. 9, 2013

(65) Prior Publication Data

US 2015/0159911 A1 Jun. 11, 2015

(51) Int. Cl.

| | |
|---|---|
| ***E21B 36/04*** | (2006.01) |
| ***H05B 6/10*** | (2006.01) |
| ***F24H 1/14*** | (2006.01) |
| ***E21B 43/26*** | (2006.01) |
| *F24H 1/08* | (2006.01) |

(52) U.S. Cl.

CPC ..... *E21B 36/04* (2013.01); *E21B 43/26* (2013.01); *F24H 1/142* (2013.01); *H05B 6/108* (2013.01); *F24H 1/08* (2013.01); *F24H 2250/08* (2013.01)

(58) Field of Classification Search

CPC ..... F24H 1/10; F24H 1/101; F24H 1/102; F24H 1/103; F24H 1/104; F24H 1/105; F24H 1/106; E21B 36/04; E21B 36/005

USPC ..... 619/630; 392/314, 319, 320, 478; 138/113

See application file for complete search history.

(56) References Cited

U.S. PATENT DOCUMENTS

| | | | | | |
|---|---|---|---|---|---|
| 1,516,836 | A * | 11/1924 | Williamson | E21B 36/04 | 392/303 |
| 2,513,242 | A * | 6/1950 | Inman | F24H 1/101 | 219/630 |
| 6,116,290 | A * | 9/2000 | Ohrn | F16L 59/143 | 138/113 |
| 6,940,054 | B1 * | 9/2005 | Heggdal | F16L 9/19 | 138/149 |
| 6,996,337 | B2 * | 2/2006 | Auber | F01N 3/2066 | 219/534 |
| 8,302,676 | B2 * | 11/2012 | Livingstone | E21B 21/12 | 166/302 |
| 2011/0211818 | A1 * | 9/2011 | Grady | B60P 3/2295 | 392/444 |

* cited by examiner

*Primary Examiner* — Kenneth L Thompson

(74) *Attorney, Agent, or Firm* — Ryan Kromholz & Manion, S.C.

(57) ABSTRACT

System and method directed to the art of heating a fluid for use in a hydraulic fracturing system. A heat tube having a plurality of pipes disposed axially along and substantially near the periphery of a medial portion of the heat tube. The heat tube is heated by induction heaters.

4 Claims, 2 Drawing Sheets

MULTI-CHANNEL CONDUIT AND METHOD FOR HEATING A FLUID

BACKGROUND OF THE INVENTION

Hydraulic fracturing, commonly referred to as "fracing," is a method of extracting hydrocarbons from a geological formation deep within the earth. The process entails a combination of drilling vertically and horizontally into the earth; introducing a mixture of water, a proppant (typically sand) to hold open the fractures, and optionally a chemical mixture to reduce equipment wear and to aid in the removal of the hydrocarbons; and building the pressure within the wellbore with the mixture until a sufficient pressure is achieved causing the formation to fracture, thus releasing the hydrocarbons which can be removed via the wellbore.

Water is an important element in the fracing process as it carries the proppant and chemicals deep into the earth. Thus the properties of the water, specifically temperature, can make a difference in overall fracing performance and efficiency. Achieving a proper water temperature may reduce the amount of chemicals needed and also decrease the amount of pressure on the pumps, pipes, and joints.

Heating the water generally involves pumping water into a heating vessel comprising a burner box, carrying the water through a coil (potentially 2"×1800' in size) over an open flame, then introducing the heated water back into the fracing system. In order to heat this much water, upwards of 400 gallons per hour of propane or diesel fuel can be consumed. It also requires the added cost of fuel delivery and storage of flammable materials, and requires an open flame located near a mining system involving chemicals under pressure. Therefore, the art of fracing could benefit from a water heating system capable of more efficiently heating the water without use of an open flame.

SUMMARY OF THE INVENTION

The present invention relates to a fluid heating device capable of heating water in a fracing process without the use of an open flame and in a way not requiring more efficient manner.

One aspect of the present invention provides a fluid heating system having a heat tube comprising a plurality of pipes positioned axially along the heat tube and substantially near the periphery of the heat tube and at least one induction heater comprising at least one conductor, wherein the at least one conductor of the at least one induction heater is positioned around the periphery of the heat tube.

The heat tube may also have an input portion, a medial portion comprising the plurality of pipes and having a medial portion first end and a medial portion second end, and an output portion, wherein the input portion adjoins the medial portion at the medial portion first end and the output portion adjoins the medial portion at the medial portion second end.

The medial portion may have a medial portion diameter and the input portion may have an input portion first end diameter, wherein the medial portion diameter is larger than the input portion first end diameter.

The input portion may be substantially frustoconical.

The output portion may have an output portion second end diameter, wherein the medial portion diameter is larger than the output portion second end diameter.

The output portion may be substantially frustoconical.

Another aspect of the present invention provides a fluid heating system for use in hydraulic fracturing having a heat tube comprising a plurality of pipes positioned axially along the heat tube and substantially near the periphery of the heat tube and at least one induction heater comprising at least one conductor, wherein the at least one conductor of the at least one induction heater is positioned around the periphery of the heat tube.

The heat tube may further comprise an input portion, a medial portion comprising the plurality of pipes and having a medial portion first end and a medial portion second end, and an output portion, wherein the input portion adjoins the medial portion at the medial portion first end and the output portion adjoins the medial portion at the medial portion second end.

Another aspect of the present invention provides a method for heating a fluid for use in hydraulic fracturing comprising the steps of providing a fluid to be heated, providing a heat tube comprising a plurality of pipes disposed axially along and substantially near the periphery of the heat tube providing at least one induction heater, providing a power source, placing the at least one induction heater about the periphery of the medial portion, supplying electricity from the power source to the induction heater, and passing the fluid through the medial portion plurality of pipes.

The heat tube may further comprise an input portion, a medial portion comprising a medial portion first end, a medial portion second end, and the plurality of pipes disposed axially along and substantially near the periphery of the medial portion, and an output portion, wherein the input portion is fluidly attached to the medial portion and the output portion is fluidly attached to the medial portion second end The method for heating a fluid for use in hydraulic fracturing may provide water as the fluid to be heated.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
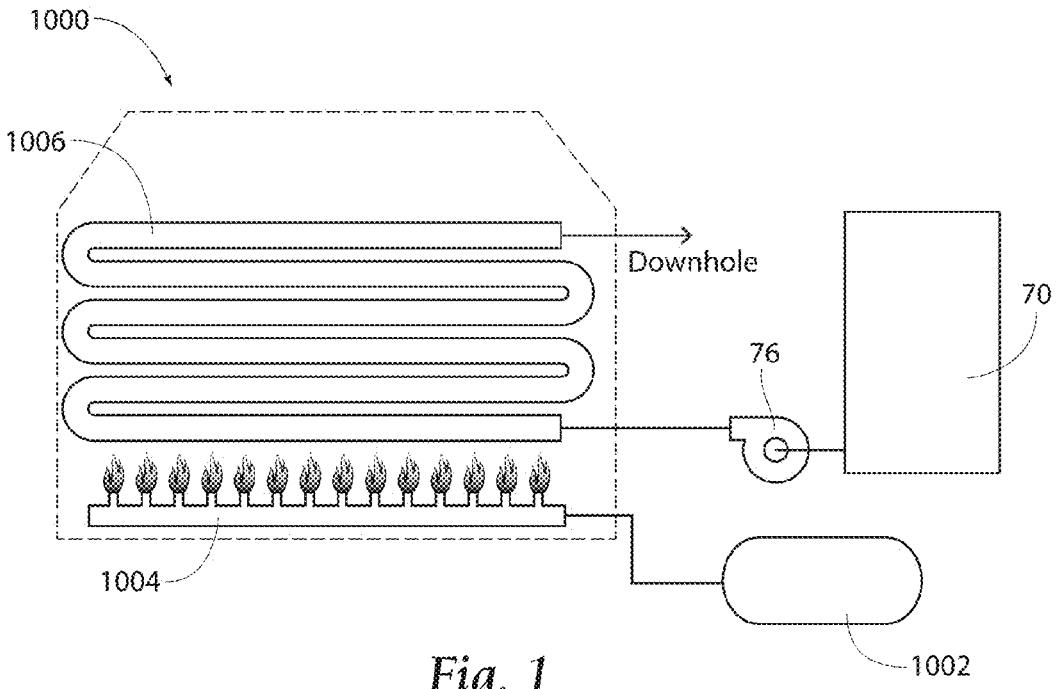
Fig. 1 PRIOR ART
FIG. 1 shows a prior art system for heating water for use in a hydraulic fracturing procedure.

FIG. 1 depicts a prior method and device 1000 for heating a fluid in a fracing system. Here a fluid, in this case water (not shown), is taken from a water source 70 and pumped by a pump 76 into a burner box 1000. The burner box 1000 houses propane burners 1004 and a coil 1006. The water flows through the coil 1006 and is heated by the propane burners 1004 with propane (not shown) supplied from a propane tank 1002. The water then exits the burner box 1000 and continues downhole. As mentioned earlier, this system requires an open flame and a substantial amount of propane to heat the water flowing through the coil 1006 to a desired temperature.

Figure 2:
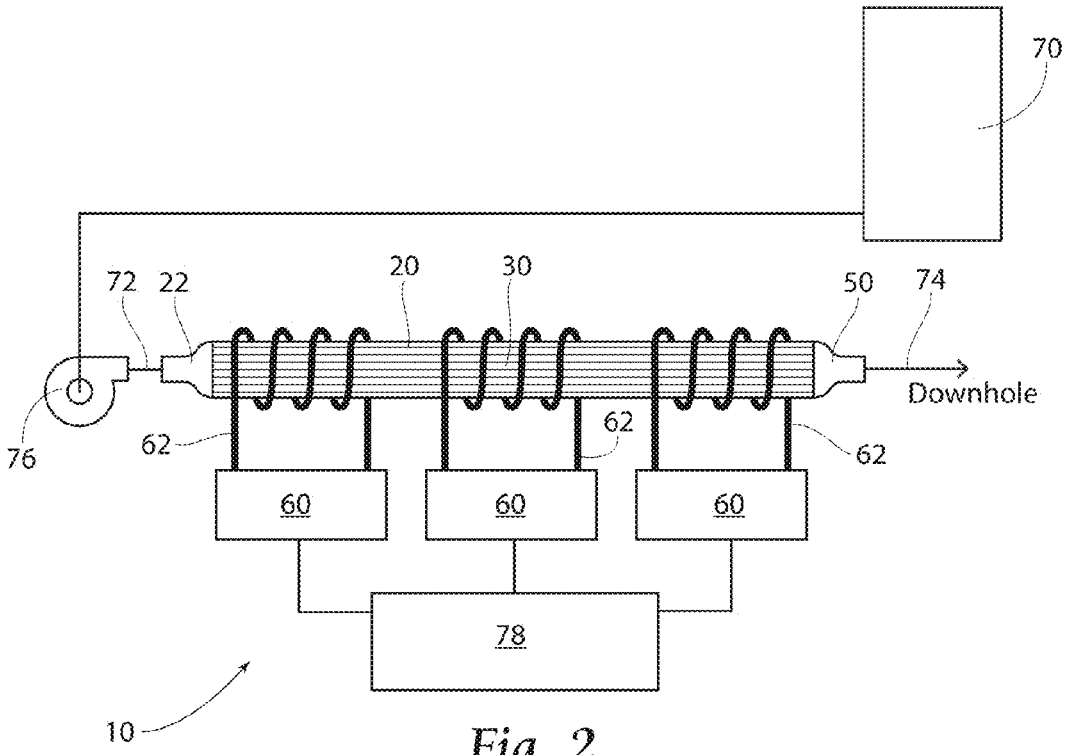
FIG. 2 illustrates a system for heating water in a hydraulic fracturing procedure according to the present invention.

A fluid heating apparatus 10 according to the present invention is illustrated in FIG. 2. The fluid heating apparatus 10 replaces the burner box 1000 of the prior art method for heating a fluid in the fracing system described above. The fluid heating apparatus 10 comprises a heat tube 20, a power source 78 (here a generator), and at least one induction heater 60. It is contemplated that any combination of the pump 76, the at least one induction heater 60, the heat tube 20, and the power source 78 may be provided on a single truck (not shown).

The at least one induction heater 60 comprises at least one conductor 62. Wherein the at least one conductor 62 is positioned around the heat tube 20. The at least one induction heater 60 is powered by the power source 78. Therefore, electricity produced by the power source 78 flows through the induction heater conductor 62 thereby producing heat which in turn transfers heat to the heat tube 20.

Figure 3:
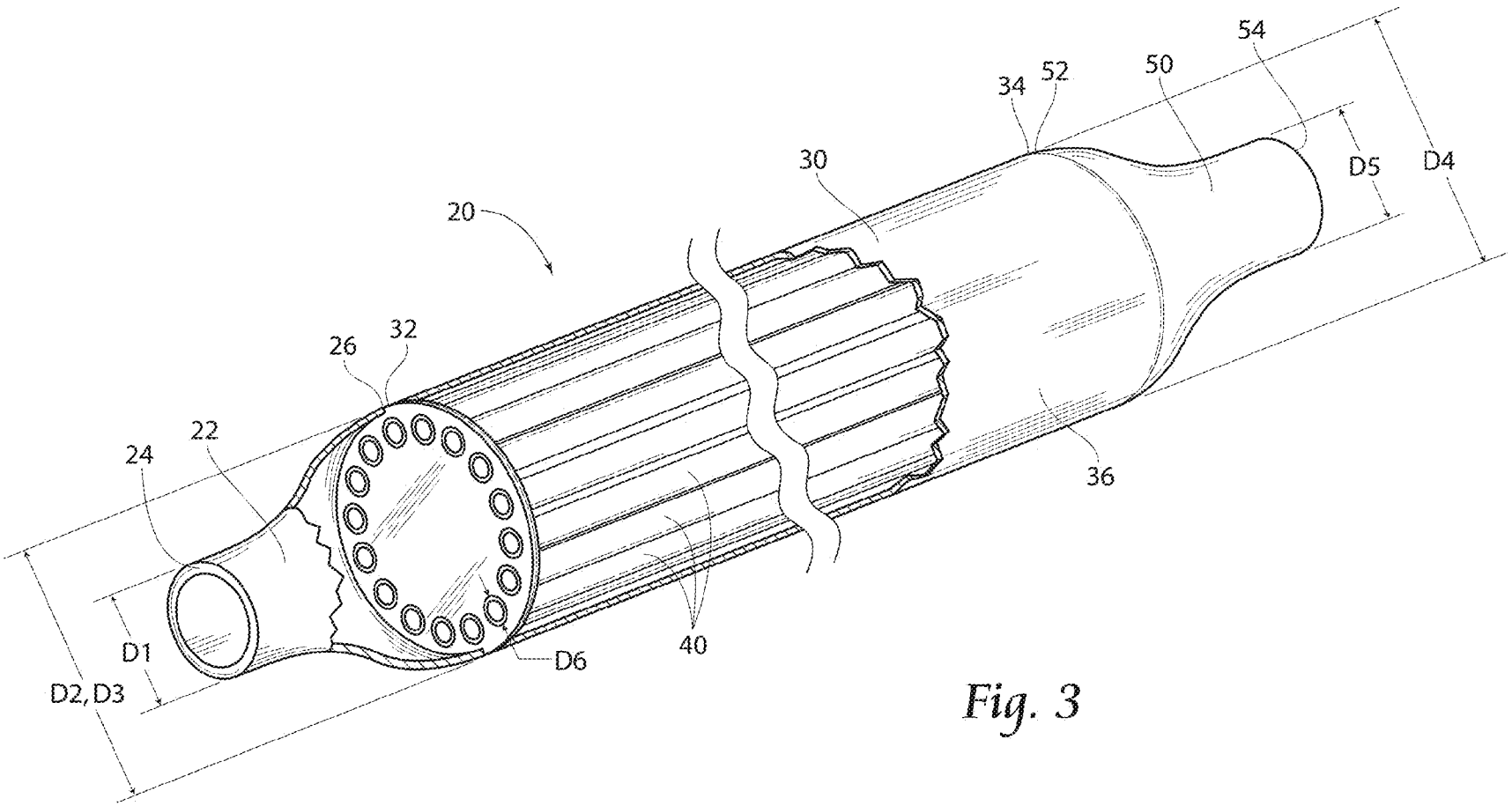
FIG. 3 is a perspective cut-away view of a heat tube according to the present invention.

Looking now to FIG. 3 in which the heat tube 20 is shown in greater detail. Here it can be seen that the heat tube 20 has a substantially circular cross-section and comprises an input portion 22 comprising an input portion first end 24 and an input portion second end 26, a medial portion 30 comprising a medial portion first end 32 and a medial portion second end 34, and an output portion 50 comprising an output portion first end 52 and an output portion second end 54. Wherein the input portion second end 26 adjoins the medial portion first end 32 and the output portion first end 52 adjoins the medial portion second end 34.

The input portion first end 24 has an input portion first end diameter D1 and the input portion second end 26 has an input portion second end diameter D2. The medial portion first end 32 and the medial portion second have a medial portion diameter D2. Furthermore, the output portion first end 52 has an output portion first end diameter D4 and the output portion second end 54 has an output portion second end diameter D5.

Moreover, the medial portion 30 comprises a plurality of individual pipes 40 disposed axially along and substantially near the periphery of the medial portion 30. The pipes 40 extend through the medial portion first end 32 and the medial portion second end 34. It is contemplated that the medial portion 30 comprises a surround 36 as shown in FIG. 3. The medial portion diameter D3 is commensurate with the number of pipes 40 employed for a preferred flow rate, pressure, and heat transfer rate.

Furthermore, the medial portion diameter D3 is substantially constant throughout the medial portion 30 and the pipes 40 are preferably linear and of a predetermined pipe diameter D6 appropriate for the preferred flow rate, pressure, and heat transfer rate.

The input portion first end diameter D1 is preferably substantially similar to the diameter of a pipe on the water-in side 72. The input portion second end 26 is fluidly connected to the medial portion first end 32. As the medial portion diameter D3 may be larger than the pipe on the water-in side 72, the input portion 22 may comprise an ever-increasing cross-sectional area from the input portion first end 24 to the input portion second end 26. Furthermore, the transition from the input portion first end diameter D1 to the input portion second end diameter D2 may be designed to promote fluid travel and to reduce the likelihood of cavitation. As non-limiting examples, the input portion may be substantially frustoconical or similar to the neck and shoulder of an olpe-type vase.

The output portion 50 is similar in design to the input portion 22. The output portion first end diameter D4 is substantially the same as the medial portion diameter D3 and the output portion second end diameter D5 is sized to be connected into a line on the water-out side 74. As the medial portion diameter D3 may be larger than the pipe on the water-out side 74, the output portion 50 may comprise an ever-decreasing cross-sectional area from the output portion first end 52 to the output portion second end 54. Furthermore, the transition from the output portion first end diameter D4 to the output portion second end diameter D5 may be designed to promote fluid travel and to reduce the likelihood of cavitation. As a non-limiting example, the output portion may be substantially frustoconical or similar to the neck and shoulder of an olpe-type vase.

Furthermore, the input portion 22 and the output portion 50 may be joined to the medial portion 30 and also to the respective water-in side 72 and the water-out side 74 in any manner known in the art. Non-limiting examples include welding and flange connections.

As stated earlier, the dimensions of the heat tube elements may be predetermined to provide various flow rates, pressures, and heat transfer rates. As a non-limiting example, the heat tube 20 may have an input portion first end diameter D1 and an output portion second end diameter D5 of approximately four inches, and the input portion second end diameter D2, the medial portion diameter D3, and the output portion first end diameter D4 may be approximately ten inches. Additionally, each pipe 40 may have a diameter D6 of 1" and be comprised of schedule 40 metal pipe.

Furthermore, referring to both FIGS. 2 and 3, the arrangement of the pipes 40 in the heat tube 20 guides the flow of the incoming water (not shown) from the water-in side 72 to substantially near the periphery of the heat tube 20. The plurality of pipes 40 provide multiple individual paths for the water, thereby dividing the incoming water into smaller individual quantities and effectively increasing the surface area of the water passing through the medial portion 30. As the water surface area is larger, it takes less energy to raise the temperature of the water in the medial portion 30 than if the water had not been divided. Additionally, because the at least one induction heater 60 is placed around the periphery of the heat tube, and the pipes 40 are placed substantially near and around the periphery of the heat tube 20, the applied heat is more evenly distributed to the water flowing through the pipes than would be if heated only from one direction.

It is contemplated that the water entering the fluid heating apparatus 10 may be first pressurized by the pump 76. It is further contemplated that the water entering the fluid heating apparatus 10 may be a diverted portion of the water supplied from the water source 70.

Additionally contemplated by the present invention is a method for more effectively heating a fluid in a fracing system. The method comprises providing a fluid to be heated; providing a heat tube comprising an input portion, a medial portion comprising a medial portion first end, a medial portion second end, and a plurality of pipes disposed axially along and substantially near the periphery of the medial portion, and an output portion, wherein the input portion is fluidly attached to the medial portion and the output portion is fluidly attached to the medial portion second end; providing at least one induction heater; providing a power source; placing the induction heater about the periphery of the medial portion; supplying electricity from the power source to the induction heater; and passing the fluid through the medial portion plurality of pipes.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A fluid heating system comprising:

a heat tube comprising an input portion, a medial portion having a medial portion first end and a medial portion second end, and an output portion;

wherein the input portion adjoins the medial portion at the medial portion first end and the output portion adjoins the medial portion at the medial portion second end;

the medial portion comprises a plurality of pipes positioned axially along the heat tube and substantially near the periphery of the heat tube;

the medial portion has a medial portion diameter and the input portion has an input portion first end diameter, wherein the medial portion diameter is larger than the input portion first end diameter;

at least one induction heater comprising at least one conductor; and wherein the at least one conductor of the at least one induction heater is positioned around the periphery of the heat tube.

2. The heat tube of claim 1 wherein the input portion is substantially frustoconical.

3. The heat tube of claim 1 wherein the output portion has an output portion second end diameter, wherein the medial portion diameter is larger than the output portion second end diameter.

4. The heat tube of claim 3 wherein the output portion is substantially frustoconical.

* * * * *